United States Patent [19]

Holtsclaw

[11] Patent Number: 4,653,663

[45] Date of Patent: Mar. 31, 1987

[54] CLAMPING ASSEMBLY FOR SECURING A FLEXIBLE LINER TO A STORAGE TANK, AND METHOD THEREFOR

[75] Inventor: David W. Holtsclaw, Waynesville, N.C.

[73] Assignee: Dayco Products, Inc., Dayton, Ohio

[21] Appl. No.: 785,805

[22] Filed: Oct. 9, 1985

[51] Int. Cl.[4] ..... F17C 1/06

[52] U.S. Cl. ..... 220/465; 220/403; 220/3

[58] Field of Search ..... 220/403, 400, 408, 409, 220/465, 470, 1 B, 3, 5 R, 5 A, 434, 85 F; 137/147

[56] References Cited

U.S. PATENT DOCUMENTS

| | | | |
|---|---|---|---|
| 2,503,339 | 4/1950 | Jandus | 220/465 X |
| 2,809,762 | 10/1957 | Cardona | 220/3 |
| 3,057,509 | 10/1962 | Bernd | 220/465 X |
| 3,172,252 | 3/1965 | Boek | 220/3 X |
| 3,247,999 | 4/1966 | Stilwell | 220/465 X |
| 3,589,403 | 6/1971 | Chase | 220/465 X |
| 3,843,010 | 10/1974 | Morse et al. | 220/3 |
| 4,360,116 | 11/1982 | Humphrey | 220/3 |

*Primary Examiner*—Steven M. Pollard
*Attorney, Agent, or Firm*—Joseph V. Tassone

[57] ABSTRACT

The present invention relates to a clamping assembly for securing a flexible liner to the inside of a rigid storage tank and to a method therefor. The clamping assembly is adapted to receive a flexible liner between an elastomeric base support and an elastomeric clamp plate, and fastening means are adapted to apply pressure to the system, retaining the flexible liner between the elastomeric base plate and the elastomeric clamp plate. The assembly further comprises at least one filling pipe and/or venting pipe which passes through a mounting plate which is adapted to be attached to the outside of the storage tank. In the method of the invention, a small hole is cut in the top of the liner, through which a rigid base plate and the elastomeric base support are inserted. The pipe is attached to the rigid base plate, and the elastomeric clamp plate and a rigid clamp plate are placed over the pipe on the outside of the liner. A mounting plate having an opening therein for passage of the pipe therethrough is placed over the pipe and is attached to the pipe. The mounting plate is then attached to the outside of the storage tank.

11 Claims, 3 Drawing Figures

CLAMPING ASSEMBLY FOR SECURING A FLEXIBLE LINER TO A STORAGE TANK, AND METHOD THEREFOR

BACKGROUND OF THE INVENTION

1. Field of the Invention

The present invention relates to a clamping assembly and a method of securing a flexible liner to a storage tank, including a fitting.

2. Information Disclosure Statement

Storage tanks are often used to store flowable materials in quantity. Storage tanks, expecially underground storage tanks, are usually made of an inexpensive material such as steel. Because steel, and similar inexpensive materials are subject to rusting, and/or corrosion in a relatively short period of time, such storage tanks often develop leaks and must be replaced. Because of the expense involved in replacing storage tanks, especially underground storage tanks which must be excavated, it has been found that it is more convenient and less costly to line existing storage tanks with a leak-proof material to prevent leakage. It has been found most convenient to line existing storage tanks with flexible liners that may be simply inserted into the storage tank. Such storage tank liners are made of a flexible material which is coated with an elastomer which is generally inert to the substance (such as water, gasoline, fuel oil, etc.) which is contained in the storage tank. The conventional flexible liner is attached to the inside of the storage tank, and filling pipes, venting pipes, and other pipes needed in the use of the storage tank are inserted into the interior of said liner. When the liner is filled with material which is to be stored, the stored material forces the liner to take the shape of the storage tank. Since the liner is flexible, when the fluid in the storage tank is depleted, the flexible liner has a tendency to collapse. When there is nothing inside the flexible liner to support the liner, all the stresses caused by the weight of the liner are concentrated on its means of attachment to the storage tank. Particularly in those cases where a large storage tank is involved, the weight of the flexible liner against this means of attachment may be considerable, creating stresses. These stresses are concentrated on a small area, creating a situation where the flexible liner can be torn and/or detached from the storage tank merely because of the force of its own weight against the means of attachment.

Accordingly, there is a need in the art for means for securing flexible storage tank liners to the inside of storage tanks so that the stresses caused by the weight of the liner do not tear or detach it.

SUMMARY OF THE INVENTION

The present invention provides a clamping assembly for securing a flexible liner, comprising a rigid clamp plate, an elastomeric clamp plate adjacent to the rigid clamp plate, an elastomeric base support disposed parallel to and opposed to the elastomeric clamp plate, a rigid base plate adjacent to the elastomeric base support on a side of the elastomeric base support opposite the elastomeric clamp plate, and fastening means for holding the assembly together. The assembly is adapted to place a flexible liner between the elastomeric base support and the elastomeric clamp plate, and the fastening means is adapted to apply pressure in opposite directions to the rigid clamp plate and rigid base plate to force said rigid base plate and said rigid clamp plate together, thereby retaining the flexible liner between the elastomeric base plate and the elastomeric clamp plate, to hold the flexible liner securely in place.

The clamping assembly includes a fitting comprising at least one pipe which passes through the clamping assembly, said pipe being adapted to provide an inlet/-outlet for said storage tank liner. This pipe is secured to the rigid base plate of the clamping assembly. A mounting plate, having at least one hole to fit over the pipe, is attached to said pipe and is adapted to be attached to the outside of the storage tank.

The present invention also provides a method of securing a flexible liner to the inside of a storage tank. The method of the invention comprises disposing a rigid base plate adjacent to an elastomeric base support, inside the flexible liner, with the elastomeric base support being adjacent to said liner. An elastomeric clamp plate is disposed adjacent to the outside of said liner, opposite the elastomeric base support, and a rigid clamp plate is disposed adjacent to the elastomeric clamp plate, and the entire assembly is held together by fastening means, thereby retaining the flexible liner between the elastomeric clamp plate and the elastomeric base support and holding the flexible liner securely in place. The pipe is inserted through aligned holes in the rigid clamp plate, the elastomeric clamp plate, the flexible liner, the elastomeric base support, and the rigid base plate, and said pipe is secured to the elastomeric base plate. The mounting plate, having a hole adapted for fitting on the pipe, is disposed on said pipe and attached thereto. The mounting plate is then attached to the outside of the storage tank.

DESCRIPTION OF THE ILLUSTRATED EMBODIMENTS

Figure 1:
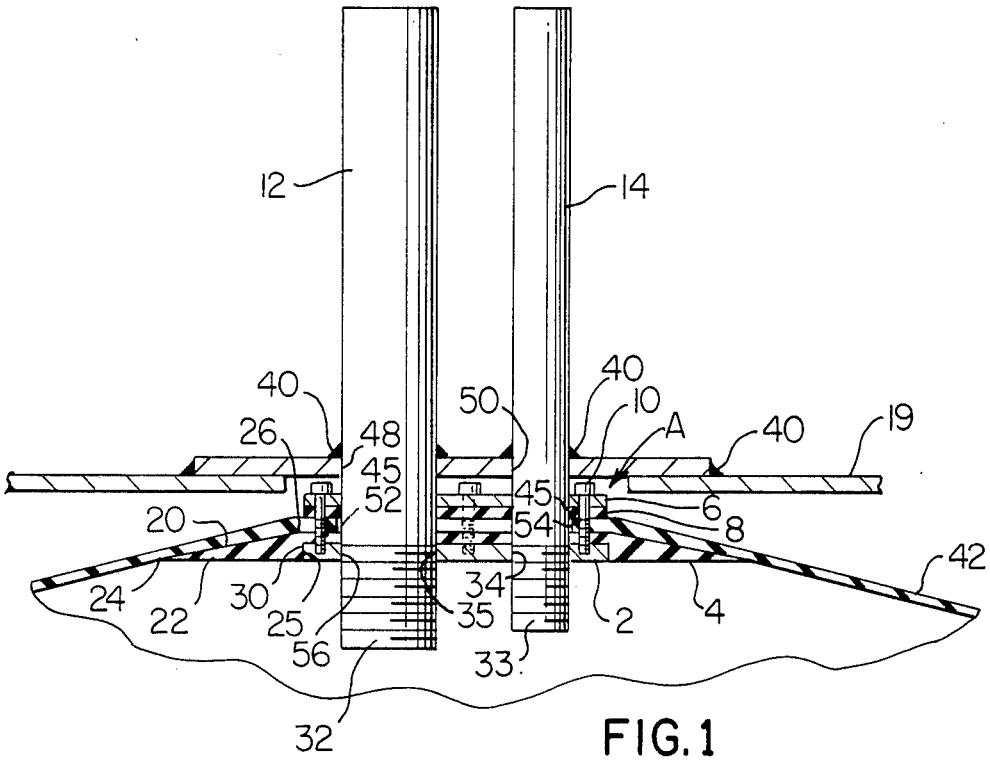
FIG. 1 illustrates the novel clamping assembly of the invention, attached to the top of a storage tank.
Figure 3:
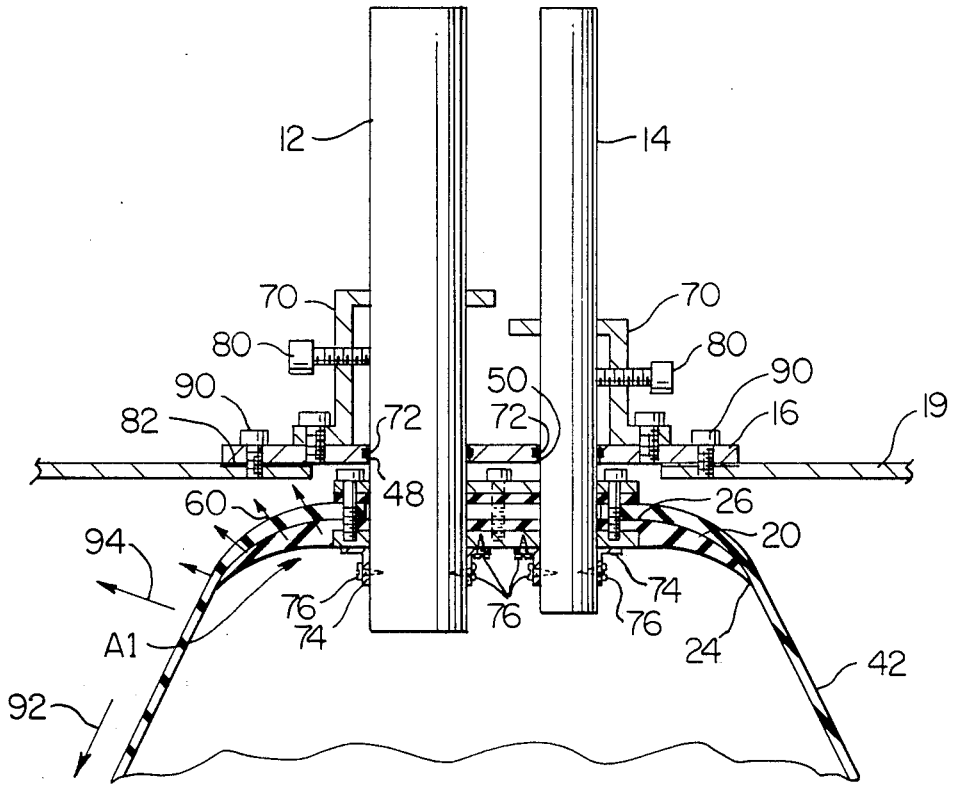
FIG. 3 illustrates an alternative embodiment of the invention wherein the pipes and mounting plate are attached using clamps and bolts.

Reference is now made to FIG. 1 which illustrates the clamping assembly of the invention, generally designated as A, attached to the top of a storage tank 19. The clamping assembly comprises a rigid base plate 2, an elastomeric base support 4, an elastomeric clamp plate 8, and a rigid clamp plate 6. In the illustrated embodiment, rigid base plate 2, elastomeric base support 4, rigid clamp plate 6, and elastomeric clamp plate 8 are fastened together using holding bolts 10, which pass through the rigid clamp plate 6, the elastomeric clamp plate 8, the elastomeric base support 4, and are threaded into the rigid base plate 2. The area of elastomeric base support 4 is greater than the area of the rigid base plate 2. The outer portion 22 of the elastomeric base support 4 has a taper 20 which terminates in point 24. Side 30 of the rigid base plate 2 provides lateral support for outer portion 22 at its thickest point 25, providing resistance to downward pressure on extended portion 22. Since it is thickest at point 26, where the taper begins, elastomeric base support 4 is resistant to bending at point 26, and is much less resistant to bending at point 24, at the end of taper 22. This variable resistance to bending has the desired effect of transferring the stresses caused by the weight of flexible liner 42 to a large area thereof, as illustrated in FIG. 3 (discussed below). This prevents the flexible liner 42 from rupturing or breaking loose from the clamping assembly A, when the contents of tank liner are removed, and the weight of said liner is supported only by clamping assembly A.

The elastomeric base support 4 of clamping assembly A may be made with a recess into which rigid base plate 2 may be embedded during assembly, or the rigid base plate 2 may be embedded into elastomeric base support 4 when it is formed, such as in a molding operation.

In the illustrated embodiment, a fill pipe 12 and a vent pipe 14 pass through the clamping assembly A. As will be recognized by those skilled in the art, additional pipes or fewer pipes may be used as desired, to provide the functions needed in a particular storage tank. For example, a third pipe may be used as an outlet to a pumping station.

In the illustrated embodiment, fill pipe 12, and vent pipe 14 have threaded ends respectively, which are adapted to be threaded into threaded holes 35 and 34 respectively in the rigid base plate 2. As shown in FIG. 3, aligned holes 44 and 45 are provided in the rigid clamp plate 6, the elastomeric clamp plate 8 and the elastomeric base support 4 for entry of the pipes 12 and 14 into the clamping assembly. The mounting plate 16, having holes 48 and 50 adapted to fit over pipes 12 and 14, is attached to said pipes. In the embodiment of FIG. 1, the pipes are attached to the mounting plate 16 using welds 40. It will be recognized by those skilled in the art, however, that appropriate sealing means, such as an elastomeric seal or O-rings 72, can be used in holes 48 and 50, and pipes 12 and 14 can be attached to mounting plate 16 using brackets or clamps 70 and screws 80 as is illustrated in FIG. 3. Mounting plate 16 is attached to the outside storage tank surface 19. It will be recognized by those skilled in the art that a sealing means, such as an elastomeric gasket 82 (FIG. 3), may be used to seal the contact between the mounting plate 16 and the surface of tank 19, and the mounting plate 16 may be attached to tank surface 19 by means of screws 90. Other equivalent alternative embodiments of the illustrated attaching means will be readily apparent.

Thus, when mounting plate 16 is attached to the surface of the storage tank, the tank supports mounting plate 16, mounting plate 16 supports pipes 12 and 14 because of their attachment to mounting plate 16 at welds 40, pipes 12 and 14 support clamping assembly A because of the attachment of pipes 12 and 14 to clamping assembly A, and clamping assembly A supports flexible liner 42.

Figure 2:
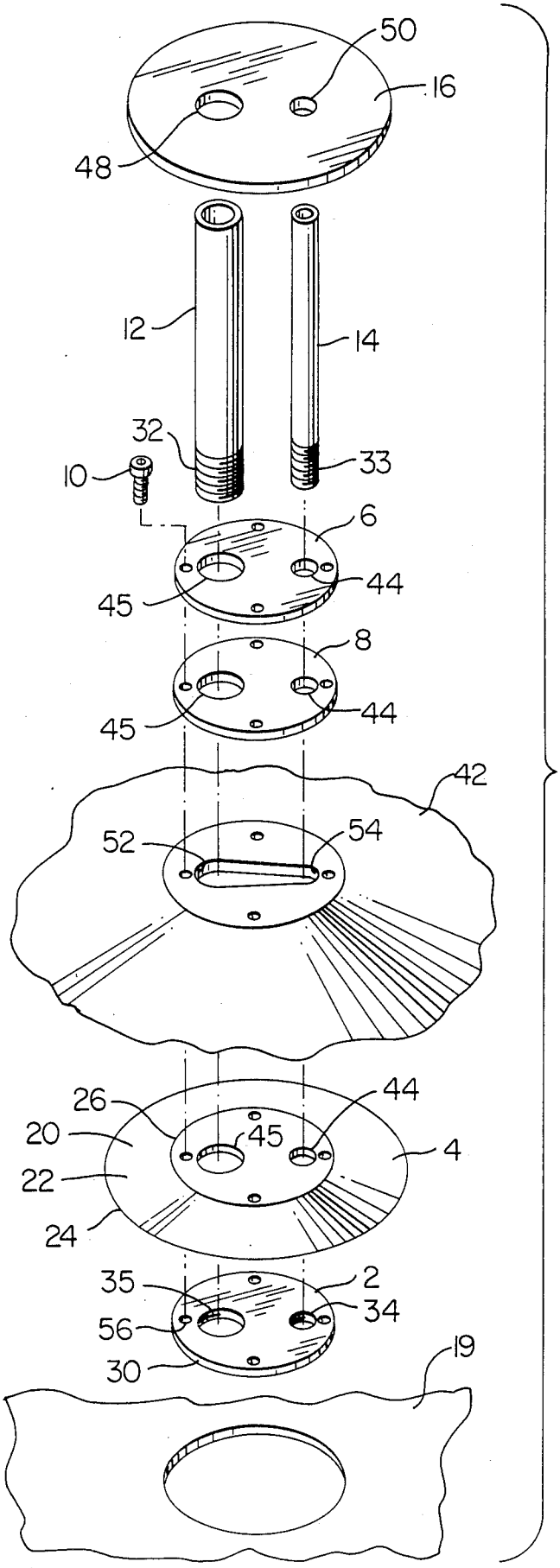
FIG. 2 is an exploded view of the clamping assembly, illustrating the method of attaching to the storage tank.

Reference is now made to FIG. 2 which illustrates an exploded view of the clamping assembly of the invention. The exploded view of FIG. 2 illustrates the assembly of the apparatus of the invention in the method of the invention. In the method of the invention, the flexible liner 42 is inserted into the storage tank through a hole in the top of the storage tank. A hole, preferably just large enough to accommodate the rigid base plate 2 and the elastomeric base support 4 is cut into the liner, and the rigid base plate 2 and the elastomeric base support 4 are inserted therethrough. The edges of the hole in the flexible liner 42 are illustrated as 52 and 54 in FIG. 1. After the rigid base plate 2 and elastomeric base support 4 are pushed through the hole into the inside of the liner 42, the rigid clamp plate 6 and elastomeric base plate 8 are disposed over the hole in the liner adjacent elastomeric base support 4 with the flexible liner 42 retained between elastomeric base support 4 and elastomeric clamp plate 8. Holding bolts 10 are then inserted through rigid clamp plate 6 and through elastomeric clamp plate 8 and through elastomeric base support 4 and threaded into threaded holes 56 in rigid base plate 2. Holding bolts 10 are tightened to retain elastomeric base support 4 and elastomeric clamp plate 8 tightly against flexible liner 42. The elastomeric material of elastomeric base support 4 and elastomeric clamp plate 8 will become distorted from the pressure applied by holding bolts 10 to make strong frictional contact with flexible liner 42, thereby holding flexible liner 42 securely in place. Fill pipe 12 is then inserted through hole 45 in the rigid clamp plate 6, elastomeric clamp plate 8, and elastomeric base support 4 and threaded into threaded hole 35 in rigid base plate 2. Similarly, vent pipe 14 is inserted into hole 44 in the rigid clamp plate 6, elastomeric clamp plate 8, and elastomeric base plate 4 and is threaded into threaded hole 34 in rigid base plate 2.

Although in the illustrated embodiment, pipes 12 and 14 are threaded into the rigid base plate for securing the pipes to the clamping assembly, it will be recognized by those skilled in the art that alternative methods of securing the pipes to the clamp assembly may be used. For example, as is illustrated in FIG. 3, a bracket 74 can be attached to rigid clamp plate 6 and bracket 74 can be subsequently attached to pipes 12 and 14 by means well known in the art such as, for example, using sheet metal screws 76.

After their attachment to clamping assembly A, pipes 12 and 14 are inserted into holes 48 and 50 in mounting plate 16, and mounting plate 16 is slid onto pipes 12 and 14 so as to be in close proximity to the clamping assembly. Mounting plate 16 is then attached to fill pipe 12 and vent pipe 14. In the illustrated embodiment of FIG. 1, mounting plate 16 is attached to fill pipe 12 and vent pipe 14 by means of weld 40. As illustrated in FIG. 3, it may be desirable to make the fitting of the invention so that it can be easily removed for simple replacement of flexible liner 42. To do this, a bracket 70 can be attached to mounting plate 16 by means well known in the art, such as sheet metal screws 80, and pipes 12 and 14 can be attached to bracket 70 in a similar manner.

After the fitting of the assembly is complete, mounting plate 16 can then be attached to the outside surface by welding, as is illustrated in FIG. 1, or by using screws 90 or other known means.

In those cases where the pipes are attached to mounting plate 16, and mounting plate 16 is attached to storage tank surface 19 by the use of screws or bolts, sealing means may be required to seal the opening between mounting plate 16 and storage tank surface 19 and between pipes 12 and 14 and mounting plate 16. In such a case, a suitable elastomeric gasket 82 or O-ring seal 72 can be used to provide such a seal in a known manner.

As is illustrated in FIG. 3, removal of the contents of storage tank 19 causes flexible liner 42 to collapse around its point of attachment to the storage tank. Since elastomeric base support 4 is more flexible at point 24 than at point 26, where the angle of taper begins, elastomeric base support 4 will be most resistant to distortion at point 26, and will be least resistant to distortion at point 24. All points of tapered surface 20 thus provide support for flexible liner 42 in decreasing amounts from point 26 to point 24, as is illustrated by arrows 60, causing the stresses on the liner to be distributed to a large extent along the strength of the liner (substantially in the direction of arrow 92) instead of being distributed across the liner (substantially in the direction of arrow 94). Since the liner has more resistance to tear when forces are applied to it lengthwise than when forces are applied transversely, this helps prevent tear of the flexible liner 42 at point 26 and thus prolonging its life.

The materials used in the clamping assembly and the fittings may vary depending on the size of the storage tank and the substance which is stored in the tank. For example, if a relatively volatile, chemically corrosive substance is stored in the storage tank, chemically resistant materials will be used in making the fitting. In such a case, metal pipes 12 and 14, a metal mounting plate 16, a metal base plate 2 and a metal clamp plate 6 may be used. An elastomer which is inert to the corrosive chemical, such as neoprene, can be used for making elastomeric base support 4 and elastomeric clamp plate 8. When the storage tank is used for other purposes, natural rubber may be used for clamp plate 8 and base support 4, a resin-impregnated laminate may be used for base plate 2 and clamp plate 6, and polyvinyl chloride may be used to make pipes 12 and 14. The materials which will be suitable for making fittings useful for a particular purpose will be readily discernable to those skilled in the art.

While present embodiments of this invention and methods of practicing the same have been illustrated and described, it will be recognized that this invention may be otherwise variously embodied and practiced within the scope of the following claims.

What is claimed is:

1. A clamping assembly for securing a flexible liner to a storage tank or the like, said assembly being disposed completely within said tank and comprising a plurality of separate liner retaining components; said components comprising upper and lower elastomeric members disposed parallel and opposite to each other, upper and lower rigid support members disposed parallel to and respectively above and below said elastomeric members, and fastening means for holding said assembly together, said liner located between said elastomeric members, said fastening means urging said rigid support members together to retain said liner between said elastomeric members, said lower elastomeric member being generally circular in shape and having a circular recess in the lower surface therof with said lower rigid suport member embedded in said recess, said lower elastomeric member having an outer portion with a taper in a downward and outward direction, said lower rigid support member providing maximum resistance to the bending of said lower elastomeric member at the point where said taper begins and a lesser resistance at the end of said taper, thereby preventing said liner from rupturing or breaking loose from said clamping assembly.

2. The assembly of claim 1 in which the area of said lower elastomeric member is greater than the area of said lower rigid support member to provide support for said flexible liner.

3. The assembly of claim 1 in which said fastening means comprises at least one bolt passing through said elastomeric members, said rigid support members, and said liner.

4. The assembly of claim 1 further comprising at least one pipe passing through said elastomeric members, said rigid support members and said liner into said tank.

5. The assembly of claim 6 in which said pipe is secured to said lower rigid support member.

6. The assembly of claim 4 further comprising a mounting plate adapted to be attached to the upper surface of said storage tank, said pipe attached to said mounting plate.

7. A method for securing a flexible liner to the inside of a storage tank or the like comprising the steps of assembling a plurality of separate liner retaining components and disposing said assembled components completely within said tank; said steps of assembling said components comprising the further steps of forming a generally circular first elastomeric member with a circular recess in the lower surface thereof, tapering said first elastomeric member in a downward and outward direction, disposing said first elastomeric member inside said liner and adjacent the inner wall thereof, disposing a first rigid support member below said first elastomeric member and within said recess, utilizing said first rigid support member to provide maximum resistance to the bending of said lower elastomeric member at the point where said taper begins and a lesser resistance at the end of said taper to prevent said liner from rupturing or breaking loose from said clamping assembly; disposing a second elastomeric member outside of said liner and adjacent the outer wall thereof and opposite said first elastomeric member, disposing a second rigid support member above and adjacent said second elastomeric member; providing fastening means for holding said elastomeric members and said rigid support members together; and urging said rigid support members toward each other by means of said fastening means to retain said liner between said elastomeric members.

8. The method of claim 7 comprising the further step of forming said first elastomeric member with an area greater than that of said first rigid support member to provide support for said liner.

9. The method of claim 7 compriasing the further steps of passing at least one pipe through said elastomeric members, said rigid support members, and said liner, and extending said pipe into said tank

10. The method of claim 9 comprising the further step of securing said pipe to said first rigid support member.

11. The method of claim 9 comprising the further steps of attaching a mounting plate on the outer surface of said storage tank, and attaching said pipe to said mounting plate.

* * * * *